US008907997B1

(12) United States Patent
Takahashi et al.

(10) Patent No.: US 8,907,997 B1
(45) Date of Patent: Dec. 9, 2014

(54) TAPE PRINTER

(71) Applicant: Brother Kogyo Kabushiki Kaisha, Nagoya-shi, Aichi-ken (JP)

(72) Inventors: Ryoya Takahashi, Gifu (JP); Masashi Tanizaki, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/225,922

(22) Filed: Mar. 26, 2014

(30) Foreign Application Priority Data

May 29, 2013 (JP) ..... 2013-113354

(51) Int. Cl.
*B41J 11/00* (2006.01)
*B41J 11/70* (2006.01)

(52) U.S. Cl.
CPC ..... *B41J 11/70* (2013.01)
USPC ..... 347/218; 400/621

(58) Field of Classification Search
USPC ..... 347/214, 215, 217–219, 222; 400/621
See application file for complete search history.

(56) References Cited

U.S. PATENT DOCUMENTS

| | | | | |
|---|---|---|---|---|
| 7,241,063 | B2 * | 7/2007 | Sago et al. | 400/621 |
| 7,497,634 | B2 * | 3/2009 | Kohira | 400/621 |
| 8,602,670 | B2 | 12/2013 | Shirotori et al. | |
| 8,783,984 | B2 * | 7/2014 | Kim et al. | 400/621 |
| 2006/0008312 | A1 | 1/2006 | Sago et al. | |
| 2008/0199239 | A1 * | 8/2008 | Kohira | 400/621 |
| 2010/0221056 | A1 | 9/2010 | Shirotori et al. | |
| 2010/0221057 | A1 | 9/2010 | Shirotori et al. | |
| 2012/0288318 | A1 | 11/2012 | Nakayama | |

FOREIGN PATENT DOCUMENTS

| | | | |
|---|---|---|---|
| JP | 2006-026931 | A | 2/2006 |
| JP | 2010-201533 | A | 9/2010 |
| JP | 2010-201676 | A | 9/2010 |
| JP | 2012-236378 | A | 12/2012 |
| JP | 2013-014015 | A | 1/2013 |

* cited by examiner

*Primary Examiner* — Kristal Feggins
(74) *Attorney, Agent, or Firm* — Banner & Witcoff, Ltd.

(57) ABSTRACT

A tape printer includes a cassette mounting portion, a cutting mechanism, a discharge outlet, a guide surface, a first projecting portion, and a second projecting portion. The cutting mechanism is a hinged type of cutting mechanism, and the hinge of the cutting mechanism is positioned in a side of the tape in a width direction. The guide surface guides the label toward the discharge outlet. The first projecting portion is provided in an area covered by a first projected image that is an image of a minimum width tape projected onto the guide surface, being projected in a position to which the minimum width tape has been conveyed toward the discharge outlet by a minimum length of the label. The second projecting portion is provided within the guide surface to the outside of the first projected image and on the opposite side of the first projected image from the hinge.

6 Claims, 12 Drawing Sheets

TAPE PRINTER

CROSS-REFERENCE TO RELATED APPLICATION

This Application claims priority to Japanese Patent Application No. 2013-113354, filed on May 29, 2013, the content of which is hereby incorporated by reference.

BACKGROUND

The present disclosure relates to a tape printer that is provided with a function that performs printing on a tape that is a printing medium.

A tape printer is known that performs printing on a tape that is a printing medium. The tape printer includes, for example, an automatic cutter, a paper guide surface, and a projecting portion. The automatic cutter cuts to a desired length a recording paper on which information has been printed, making a cut piece of the paper. The paper guide surface is positioned on the downstream side of a paper conveyance path of the automatic cutter and is set at a lower level than an area through which the recording paper passes in a horizontal direction, such that the paper guide surface defines the bottom of the cut piece of the paper. The projecting portion is provided on the top face of the paper guide surface and projects toward the cut piece of the paper in an area that is not in a central portion of the width direction of the cut piece of the paper. The cut piece of the paper is held by the paper guide surface and the projecting portion such that the cut face on the upstream end of the paper covers a portion of the area through which the recording paper is conveyed.

SUMMARY

In the tape printer that is described above, the distance that a conveyance path of the paper guide surface extends is comparatively short. Therefore, in a case where the distance is comparatively long in the direction in which the conveyance path of the paper guide surface extends, the cut piece of the paper may not be discharged smoothly, even if the projecting portion that meets the conditions described above is provided.

Various embodiments of the present disclosure provide a tape printer that is provided with a function that performs printing on tapes that have a plurality of widths, the tape printer being capable of reliably discharging a cut tape even in a case where the distance to the discharge outlet from a position where the tape is cut is comparatively long.

A tape printer according to an embodiment of the present disclosure includes a cassette mounting portion, a cutting mechanism, a discharge outlet, a guide surface, a first projecting portion, and a second projecting portion. The cassette mounting portion is configured to be provided with a tape cassette containing a tape that is a printing medium. The cutting mechanism is a hinged type of cutting mechanism and that includes a hinge positioned in a side of the tape in a width direction. The cutting mechanism is configured to cut the tape, which is supplied from the tape cassette that is provided in the cassette mounting portion and is conveyed along a specified conveyance path. The discharge outlet is provided on a downstream side of the cutting mechanism in a conveyance direction of the conveyance path along which the tape is conveyed. The discharge outlet discharges a label that is the tape that has been cut by the cutting mechanism. The guide surface is provided between the cutting mechanism and the discharge outlet and that guides the label toward the discharge outlet. The first projecting portion is provided in an area that is covered by a first projected image. The first projected image is an image of a minimum width tape that is projected onto the guide surface from a direction that is orthogonal to the conveyance path, and is projected in a position to which the minimum width tape has been conveyed from the cutting mechanism toward the discharge outlet by a minimum length of the label. The minimum width tape is a tape whose width is the smallest of any tape that is supplied from the tape cassette that is provided in the cassette mounting portion. The second projecting portion is provided within the guide surface to an outside of the first projected image and on an opposite side of the first projected image from the hinge.

BRIEF DESCRIPTION OF THE DRAWINGS

Embodiments will be described below in detail with reference to the accompanying drawings in which.

DETAILED DESCRIPTION

An embodiment that implements the present disclosure will be explained with reference to the drawings. Note that the drawings are used for explaining technological features that the present disclosure can utilize and do not serve to restrict the content of the present disclosure. In the explanation of the present embodiment, the lower right side, the upper left side, the lower left side, the upper right side, the top side, and the bottom side in FIG. 1 respectively correspond to the right side, the left side, the front side, the rear side, the top side, and the bottom side of a tape printer 1. In FIG. 2, the lower right side, the upper left side, the lower left side, the upper right side, the top side, and the bottom side respectively correspond to the top side, the bottom side, the front side, the rear side, the left side, and the right side of the tape printer 1 and a tape cassette 30. With respect to a conveyance path C along which a tape 57 that is supplied from the tape cassette 30 is conveyed and a discharge path along which the tape 57 is discharged, the side where the tape cassette 30 is located is called the upstream side, and the side where a discharge outlet 20 is located is called the downstream side.

The tape printer 1 will be explained with reference to FIGS. 1 to 11. The tape printer 1 is a general-purpose tape printer that can be electrically connected to a computer (for example, a personal computer). Based on data that are transmitted from the computer and that describe characters (text characters, numerals, figures, and the like), the tape printer 1 performs the printing of the characters on a tape that is a printing medium that is supplied from the tape cassette 30. The tape printer 1 is able to use various types of the tape cassette 30, such as a thermal type, a receptor type, a laminated type, a tube type, and the like. The type of the tape varies according to the type of the tape cassette 30. The types of tape include, for example, a thermal paper tape, a printing tape, a double-sided adhesive tape, a tube tape, and a film tape. The thermal type tape cassette is provided with the thermal paper tape. The receptor type tape cassette is provided with the printing tape and an ink ribbon. The laminated type tape cassette is provided with the double-sided adhesive tape, the film tape, and an ink ribbon. The tube type tape cassette is provided with a heat-shrinkable tube tape and an ink ribbon. In the explanation that follows, where the type of tape that is contained in the tape cassette 30 is called by a general name, as well as in a case where the type of the tape is not specified, it will simply be called the tape. Attributes of the tape that is contained in the tape cassette 30 (for example, the tape width, the form of printing, the tape color, the printing color, and the like) will collectively be called the tape attributes.

Figure 1:
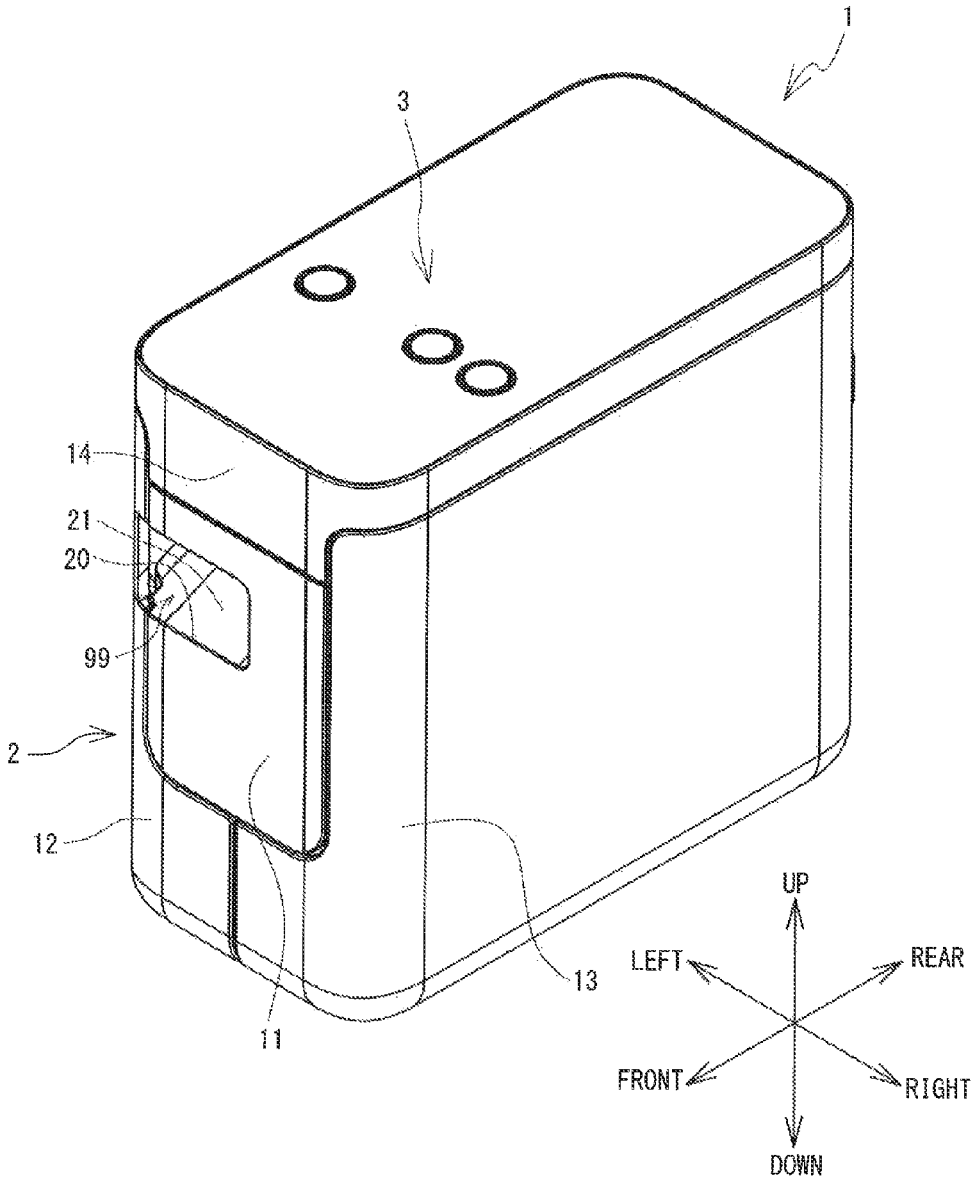
FIG. 1 is an oblique view of a tape printer 1.
Figure 2:
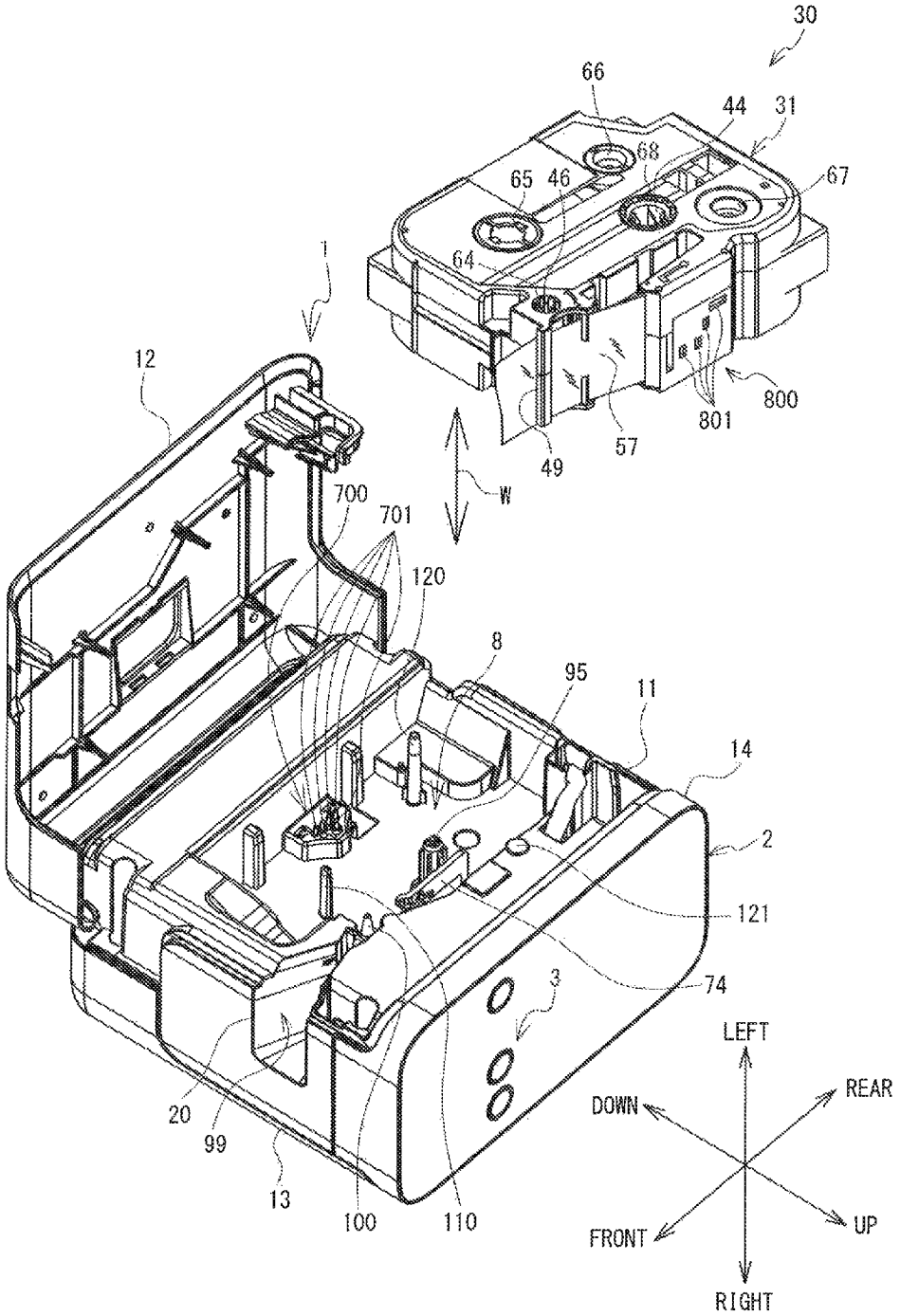
FIG. 2 is an oblique view of the tape printer 1 in a state in which a left cover 12 is open and of a tape cassette 30 prior to its mounting in a cassette mounting portion 8.

As shown in FIGS. 1 and 2, the tape printer 1 is provided with a body cover 2 whose shape is approximately a three-dimensional rectangle. The body cover 2 includes a body 11, a left cover 12, a right cover 13, and a top cover 14. In FIG. 1, the left side, the right side, and the top side of the body 11 are respectively covered by the left cover 12, the right cover 13, and the top cover 14. A cassette mounting portion 8, a printing mechanism 70, a cutting mechanism 80, a discharge portion 99, and a battery compartment (not shown in the drawings) are provided in the body 11. The cassette mounting portion 8 is an element into and from which the tape cassette 30 can be mounted and removed. The printing mechanism 70 is configured such that it performs printing on the tape 57 that is supplied from the tape cassette 30. The cutting mechanism 80 is provided on the downstream side of the printing mechanism 70 and is configured such that it cuts the printed tape 57 to a specified length. The discharge portion 99 is an element that discharges a label to the outside of the tape printer 1, the label being the tape that has been cut by the cutting mechanism 80. The cassette mounting portion 8, the printing mechanism 70, the cutting mechanism 80, and the discharge portion 99 are each provided on the left side of the body 11. The battery compartment is provided on the right side of the body 11 and is capable of accommodating a battery that supplies electric power to the tape printer 1. The cassette mounting portion 8, the printing mechanism 70, the cutting mechanism 80, and the discharge portion 99 will be described later.

Figure 3:
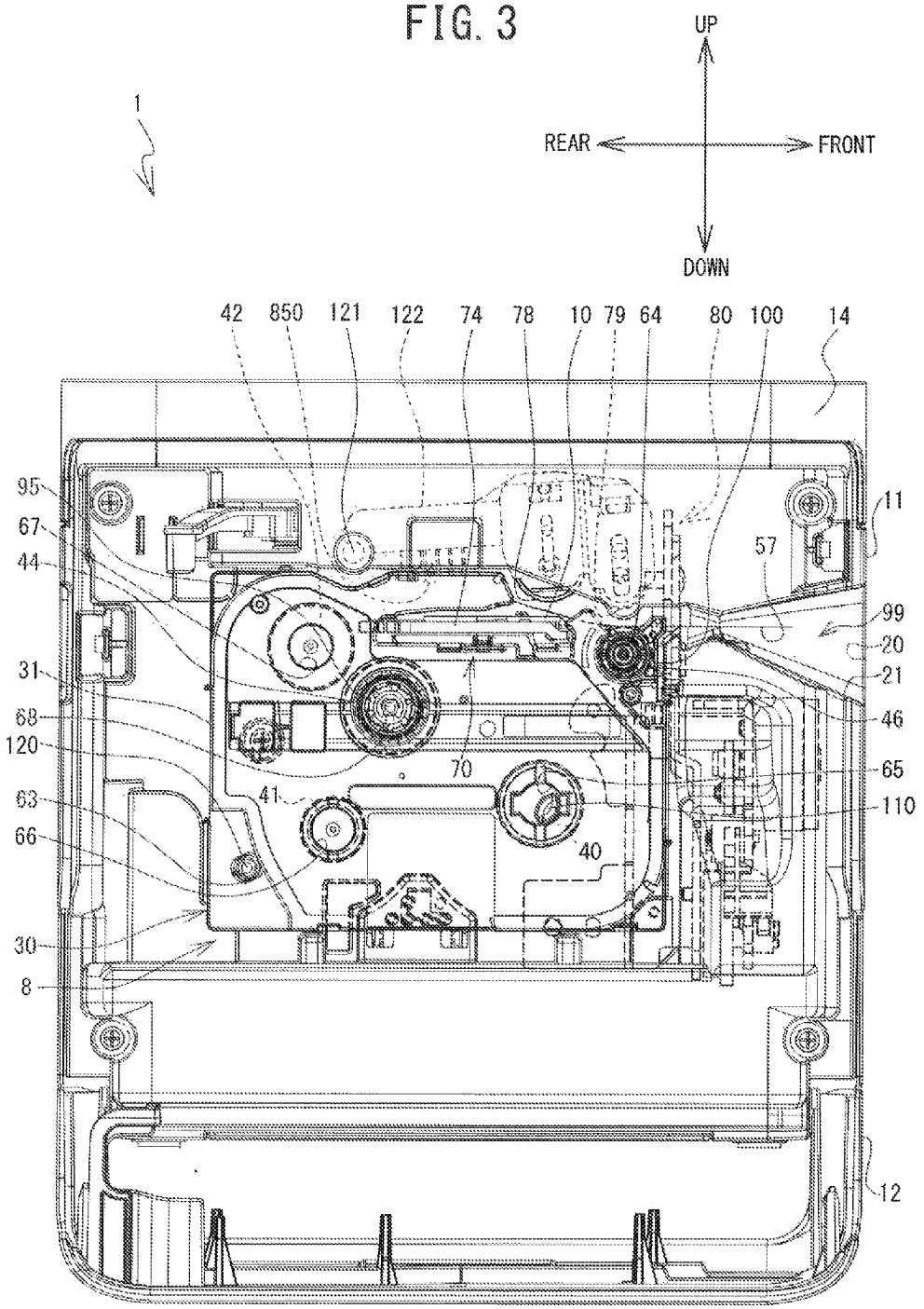
FIG. 3 is a left side view of the tape printer 1 in the state in which the left cover 12 is open and of the tape cassette 30 after its mounting in the cassette mounting portion 8.

The left cover 12 is rectangular in a left side view. The left cover 12 is axially supported in the front-rear direction in the lower left part of the body 11 and can pivot between a closed position that is shown in FIG. 1 and an open position that is shown in FIGS. 2 and 3. In a case where the left cover 12 is in the closed position that is shown in FIG. 1, the left cover 12 covers the left side of the body 11. The left cover 12 is moved to the open position when the tape cassette 30 is mounted or removed, for example. The right cover 13 is rectangular in a right side view and can be mounted on and removed from the body 11. In a case where the right cover 13 has been mounted on the body 11, the right cover 13 covers the right side of the body 11. The right cover 13 is operated when the battery is mounted in or removed from the battery compartment (not shown in the drawings), for example. The top cover 14 can be mounted on and removed from the body 11. An operation portion 3 is provided on the top face of the top cover 14. The operation portion 3 is operated when various types of commands are input, such as switching the power supply on and off.

The tape cassette 30, which can be mounted in the cassette mounting portion 8, will be explained with reference to FIGS. 2 and 3. As shown in FIG. 2, the tape cassette 30 is provided with a cassette case 31 whose overall shape is a three-dimensional rectangle (a box shape) with rounded corners. Except for a first indicator portion 800 and a second indicator portion (not shown in the drawings), which will be described later, the shape of the cassette case 31 is the same regardless of the type of the tape cassette 30 or the tape attributes.

The cassette case 31 is provided with three support holes 64, 65, and 68 that pass through the cassette case 31 in the left-right direction. As shown in FIG. 3, the support hole 64 supports a roller 46 such that the roller 46 can rotate. The roller 46, together with a movable feed roller 79 that will be described later, feeds the tape that is supplied from the cassette case 31 along the specified conveyance path C (refer to FIG. 5). Each one of the support holes 65 and 68 supports a spool that is mounted in the interior of the cassette case 31, such that the spool can rotate. The support hole 65 supports a spool 40, around which a tape is wound, such that the spool 40 can rotate. The support hole 68 supports a spool 44 for winding up a tape that is supplied from a spool 42, such that the spool 44 can rotate. The cassette case 31 is also provided with support holes 66 and 67, which are provided such that they extend in the left-right direction. The support hole 66 supports a spool 41, around which a tape is wound, such that the spool 41 can rotate. The support hole 67 supports the spool 42, around which a tape is wound, such that the spool 42 can rotate. The cassette case 31 is also provided with a hole 63 that passes through the cassette case 31 in the left-right direction in the lower rear part of the cassette case 31. The types of the tapes that are wound around the spools 40 to 42 are set in accordance with the type of the tape cassette 30.

As shown in FIG. 2, the cassette case 31 is provided with the first indicator portion 800, which indicates a portion of the tape attributes of the tape cassette 30 on its top face. The first indicator portion 800 includes at least one hole 801 that is provided in a pattern that is prescribed in accordance with a portion of the tape attributes of the tape cassette 30. Each one of the at least one hole 801 is provided in a position that corresponds to one of five detection switches (not shown in the drawings) that are provided in a first detection portion 850 (refer to FIG. 3) that is provided in the tape printer 1. Accordingly, when the tape cassette 30 is mounted in the tape printer 1, the detection switches are selectively depressed by the first indicator portion 800. In the tape printer 1, a portion of the tape attributes of the tape cassette 30 are detected based on a combination of on states and off states of the detection switches of the first detection portion 850. A tape attribute that the first indicator portion 800 indicates may be the tape width, for example. The tape width is the size of the tape in a direction that is orthogonal to the longitudinal axis of the tape, the direction being shown as a width direction W in FIG. 2. The minimum tape width Wmin of the tape cassette 30 that can be mounted in the tape printer 1 of the present embodiment is 6 millimeters, and the maximum tape width Wmax is 24 millimeters.

The second indicator portion (not shown in the drawings) is similarly provided in the lower portion of the right wall of the cassette case 31. The second indicator portion includes at least one hole that is provided in a pattern that is prescribed in accordance with a tape attribute (for example, the tape color)

that is different from the tape attributes that are indicated by the first indicator portion 800. Each one of the at least one hole that is provided in the second indicator portion is provided in a position that corresponds to one of five detection switches 701 that are provided in a second detection portion 700 that is provided in the tape printer 1 that is shown in FIG. 2. Accordingly, when the tape cassette 30 is mounted in the tape printer 1, the detection switches 701 are selectively depressed by the second indicator portion. In the tape printer 1, the tape attribute of the tape cassette 30 is detected based on a combination of on states and off states of the detection switches 701 at that time. A discharge guide portion 49 that guides the tape 57 toward the cutting mechanism 80 is provided in the upper front portion of the cassette case 31.

The cassette mounting portion 8 will be explained with reference to FIGS. 2 and 3. As shown in FIG. 2, the tape cassette 30 can be mounted in and removed from the cassette mounting portion 8 in a left-right direction. The cassette mounting portion 8 is recessed in such a way that its shape corresponds substantially to the shape of the right side face of the cassette case 31. The second detection portion 700 is provided in the lower right portion of the cassette mounting portion 8. In the second detection portion 700, the five detection switches 701 project to the left. As explained previously, when the tape cassette 30 is mounted in the cassette mounting portion 8, the detection switches 701 are positioned opposite the second indicator portion (not shown in the drawings), which is provided on the right side of the tape cassette 30.

The cassette mounting portion 8 is provided with shafts 95, 100, 110, and 120, which extend from the right to the left. The shaft 95 is provided on the upper side of the cassette mounting portion 8, in a central portion in the front-rear direction. As shown in FIG. 3, the shaft 95 can be inserted into the spool 44 of the tape cassette 30. The shaft 100 is provided toward the front from the shaft 95. The shaft 100 can be inserted into a shaft hole in the roller 46 of the tape cassette 30. The shaft 110 is provided below and to the rear of the shaft 100. The shaft 110 can be inserted into the support hole 65 of the tape cassette 30. The shaft 120 is provided in the lower rear portion of the cassette mounting portion 8. The shaft 120 can be inserted into the hole 63 of the tape cassette 30.

The printing mechanism 70 will be explained with reference to FIG. 3. The printing mechanism 70 is configured such that it performs printing on the tape that is supplied from the cassette mounting portion 8, based on the data that are transmitted from the computer (not shown in the drawings). The printing mechanism 70 is provided with a head holder 74. The head holder 74 is provided in the upper portion of the cassette mounting portion 8. The head holder 74 is formed from a single plate member that extends in the front-rear direction. A thermal head 10 that is provided with a heating element (not shown in the drawings) is provided on the top face of the head holder 74.

The printing mechanism 70 is provided with an arm-shaped platen holder 122 that extends in the front-rear direction above the head holder 74. The platen holder 122 is axially supported such that it is swingable around an axial support portion 121 of the body 11. A platen roller 78 and the movable feed roller 79 are axially supported in the front portion of the platen holder 122 such that they can rotate. The platen roller 78 is opposite the thermal head 10 and is able to come into contact with and move away from the thermal head 10. The movable feed roller 79 is opposite the roller 46 of the tape cassette 30 and is able to come into contact with and move away from the roller 46 of the tape cassette 30. A tape drive motor (not shown in the drawings) that is a stepping motor is disposed behind (on the right side of) the cassette mounting portion 8. The shaft 95 and the roller 46 are respectively connected to the tape drive motor through pluralities of gears (not shown in the drawings) and are configured such that they rotate in conjunction with the operating of the tape drive motor.

When the left cover 12 is in the closed position, the platen holder 122 moves toward a printing position. In the printing position, the platen holder 122 is close to the cassette mounting portion 8. Specifically, in a case where the receptor type of the tape cassette 30 has been mounted in the cassette mounting portion 8, the platen roller 78 presses the printing tape and the ink ribbon (not shown in the drawings) against the thermal head 10. At the same time, the movable feed roller 79 presses the tape 57 against the roller 46. Within the tape cassette 30, the printing tape and the ink ribbon are conveyed along the conveyance path C in conjunction with the rotating of the shaft 95, the roller 46, the platen roller 78, and the movable feed roller 79. The thermal head 10 uses the ink ribbon to perform printing on the printing tape.

Figure 4:
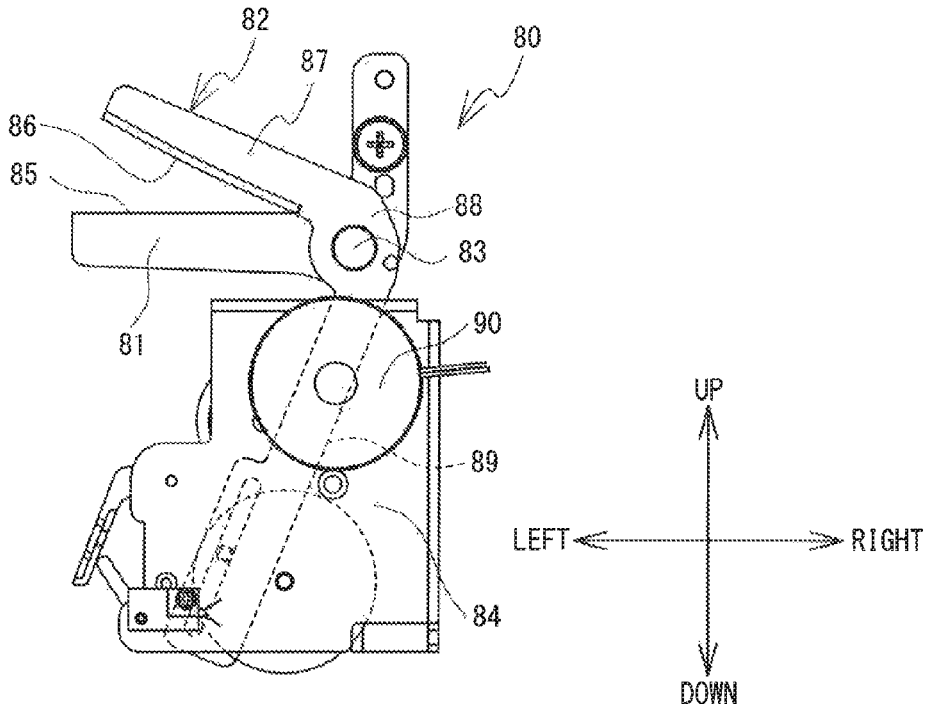
FIG. 4 is a front view of a cutting mechanism 80.

The cutting mechanism 80 will be explained with reference to FIGS. 3 and 4. The cutting mechanism 80 is a known hinged type of mechanism that is configured such that it makes a label by cutting the printed tape 57 to a specified length. The specified length may be prescribed by data that are transmitted from the computer, for example. The cutting mechanism 80 is provided between the cassette mounting portion 8 and the discharge portion 99 in the front-rear direction. As shown in FIG. 4, the cutting mechanism 80 is provided with a fixed blade 81, a movable blade 82, a hinge 83, a support plate 84, and a motor 90. The fixed blade 81 extends in the left-right direction and has a cutting edge 85 on its upper side. The movable blade 82 forms a V shape in a front view and is provided with a cutting edge 86, a shank portion 87, a curved portion 88, and a transmitting portion 89. The cutting edge 86 is formed on the lower side of the shank portion 87 and is opposite the cutting edge 85 of the fixed blade 81. The curved portion 88 is a curved element that connects the shank portion 87 and the transmitting portion 89. The hinge 83 is provided in the curved portion 88. The movable blade 82 is supported by the support plate 84 such that the movable blade 82 can pivot around the hinge 83. The motor 90 is affixed to the front face of the support plate 84 and operates such that it can pivot the movable blade 82. The driving force of the motor 90 is transmitted to the transmitting portion 89 of the movable blade 82 through a gear (not shown in the drawings) that is provided on the rear face of the support plate 84, and it drives the pivoting of the movable blade 82. The tape 57 that is pinched between the cutting edge 85 and the cutting edge 86 is cut by the pivoting of the movable blade 82.

Figure 5:
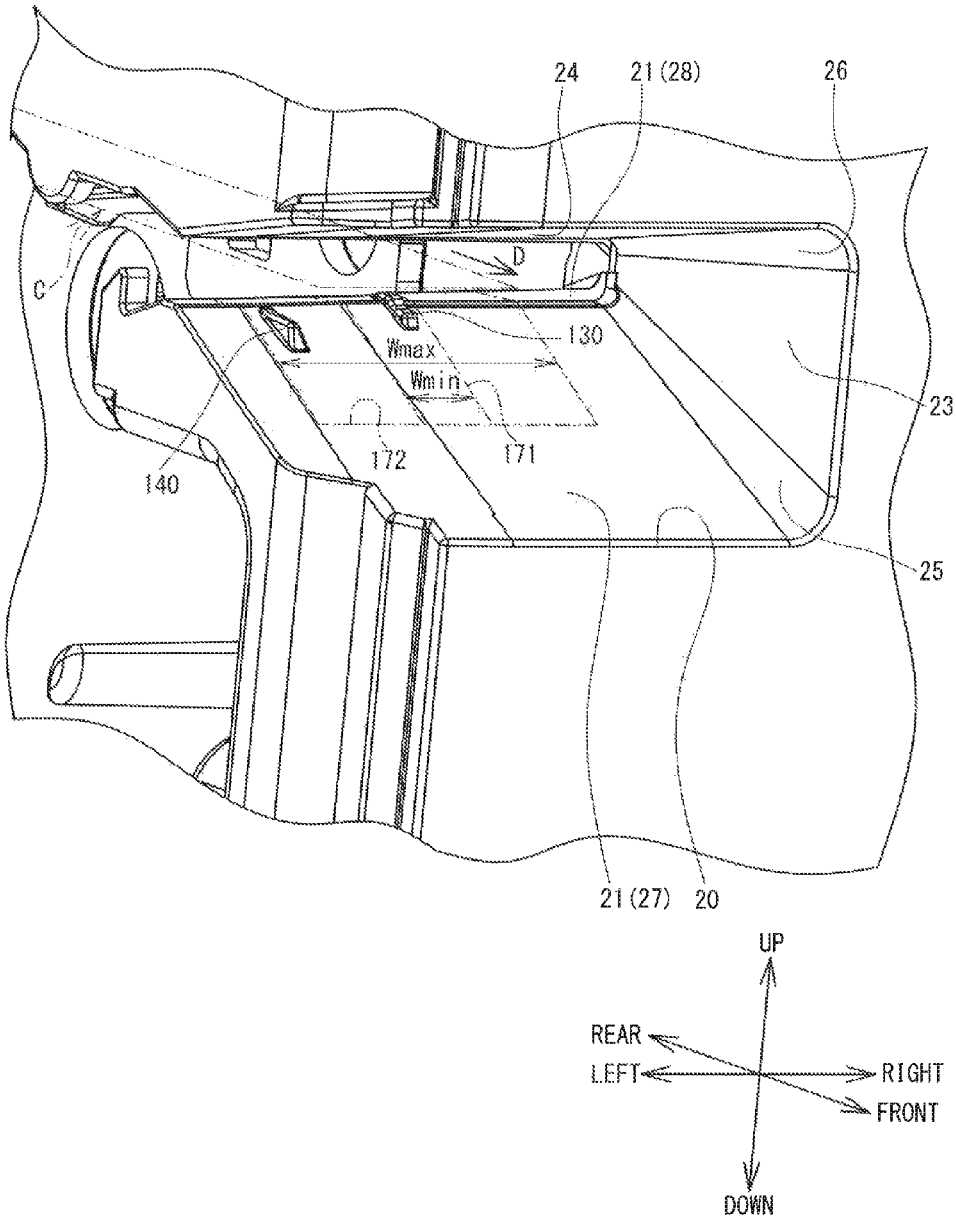
FIG. 5 is a partial enlarged oblique view of an area around a discharge portion 99 in the state in which the left cover 12 is open.
Figure 6:
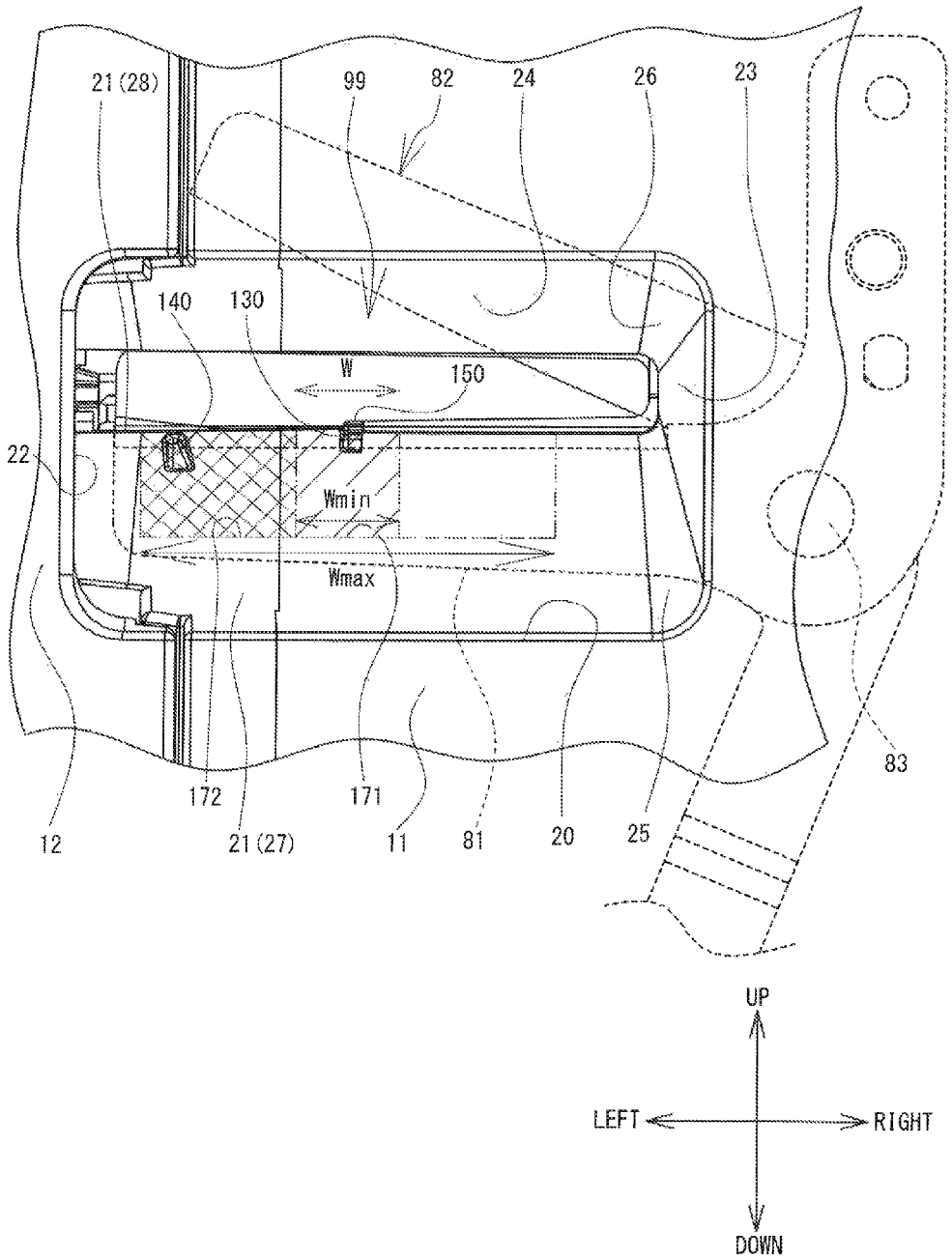
FIG. 6 is an enlarged partial front view of the area around the discharge portion 99.
Figure 7:
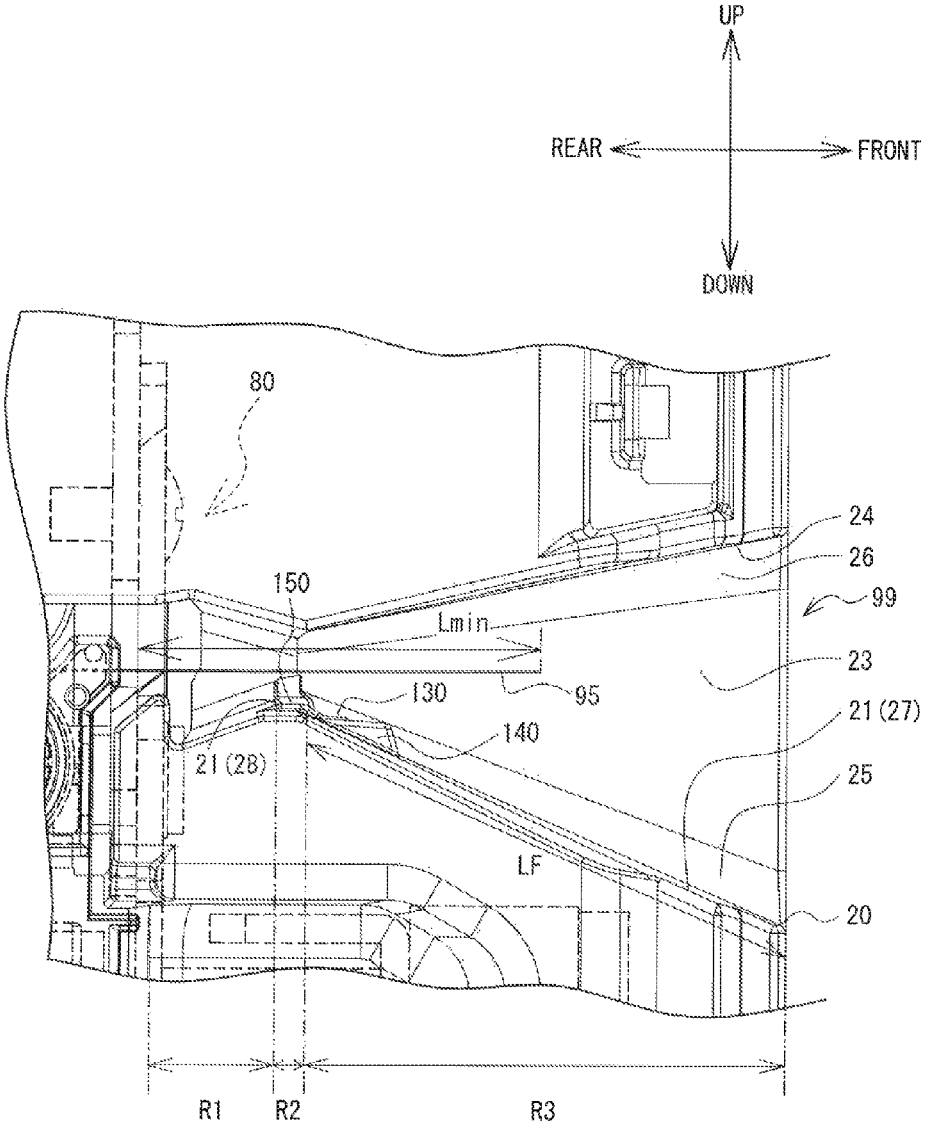
FIG. 7 is an enlarged partial view of the area around the discharge portion 99 in FIG. 3.

The discharge portion 99 will be explained with reference to FIG. 3 and FIGS. 5 to 7. The discharge portion 99 is an element that is provided with the discharge outlet 20 and is located between the discharge outlet 20 and the cutting mechanism 80. From discharge outlet 20, the discharge portion 99 discharges the label that has been created by the cutting mechanism 80 to the outside of the tape printer 1. As shown in FIGS. 3 and 5, the discharge outlet 20 has a rectangular shape whose long axis extends in the left-right direction in a front view, and it is positioned on a conveyance direction D of the conveyance path C of the tape 57. As shown in FIG. 6, the discharge portion 99 is provided with surfaces 21 to 26. The surfaces 21 to 26 are respectively provided on the bottom side, the left side, the right side, the top side, the lower right side, and the upper right side of the discharge portion 99. As shown in FIG. 7, the angles of inclination of at least the surface 21 and the surface 24 in relation to the horizontal plane vary according to the position in the front-rear direction. In a range R1 that is closest to the cutting mechanism 80 in the front-rear direction, the surface 21 is inclined upward toward the front. In a range R2 that is continuous with the range R1 in the front-rear direction, the surface 21 is substantially parallel to the horizontal plane. In a range R3 that is continuous with the range R2 in the front-rear direction, the surface 21 is inclined downward toward the front. Similarly, the surface 24 is inclined downward toward the front in the range R1 and the range R2 in the front-rear direction. The surface 24 is inclined upward toward the front in the range R3 in the front-rear direction. Within the surface 21, the surface that is inclined downward toward the front in the range R3 is called a guide surface 27, and the surface that is substantially horizontal in the range R2 is called a horizontal surface 28. A first projecting portion 130 and a second projecting portion 140 are provided on the guide surface 27, and a third projecting portion 150 that is provided with top faces 151 to 153 is provided on the horizontal surface 28. The third projecting portion 150 reduces friction between the tape and the surface 21 while the tape is being conveyed. The guide surface 27 is provided between the cutting mechanism 80 and the discharge outlet 20 such that it is inclined in relation to the horizontal surface 28, and it uses gravity to guide the label to the discharge outlet 20. A length LF of the guide surface 27 in a longitudinal direction toward the discharge outlet 20 is greater than a minimum length Lmin of the tape 57. Each one of the first projecting portion 130, the second projecting portion 140, and the third projecting portion 150 is a projecting portion that projects upward.

The first projecting portion 130 and the second projecting portion 140 that are provided on the guide surface 27 will be explained with reference to FIGS. 5 to 11. As shown in FIGS. 5 and 6, the first projecting portion 130 projects upward from the guide surface 27 that is provided in a position that is within a first projected image 171. The first projected image 171 is an image of a first reference tape that is projected onto the guide surface 27 from a direction that is orthogonal to the conveyance path C. The first reference tape is the tape in a case where a minimum width tape, whose width is the smallest of any tape that is supplied from the tape cassette 30 that is mounted in the cassette mounting portion 8, is conveyed along the conveyance direction D of the conveyance path C by the minimum length Lmin that is shown in FIG. 7. In the present embodiment, the minimum tape width Wmin is 6 millimeters, and the minimum length Lmin is 24.5 millimeters. The value of the minimum length Lmin is determined by a head-to-cutter distance Lhc (not shown in the drawings), which is the distance between the thermal head 10 and the cutting mechanism 80. Ordinarily, the value of the minimum length Lmin is greater than the distance Lhc by the length of a trailing margin. The length of the trailing margin is the length of the margin that is provided on the trailing end of the tape, along the conveyance direction D. In the present embodiment, the tape that is supplied from the tape cassette 30 is conveyed such that the center of the tape is always in the same position in the width direction of the tape, regardless of the tape width. The first projected image 171 in the present embodiment is projected in a central portion of the guide surface 27 in the left-right direction. The area that is covered by the first projected image 171 is the area that is shown as shaded by slanting lines in FIG. 6. Within the area that is covered by the first projected image 171, the first projecting portion 130 in the present embodiment is positioned on a center line M of the first projected image 171 (refer to FIG. 11) in the width direction W, close to the boundary between the guide surface 27 and the horizontal surface 28.

The second projecting portion 140 is provided within the guide surface 27 to the outside of the first projected image 171 and on the opposite side of the first projected image 171 from the hinge 83 of the cutting mechanism 80. As shown in FIG. 6, in the tape printer 1 of the present embodiment, the hinge 83 of the cutting mechanism 80 is provided on the right side of the guide surface 27. Therefore, the second projecting portion 140 is provided within the guide surface 27 to the outside of the first projected image 171 and in an area that is to the left of the first projected image 171.

In the present embodiment, in addition to being subject to the conditions described above, the second projecting portion 140, in particular, is provided in an area that is covered by a second projected image 172. The second projected image 172 is an image of a second reference tape that is projected onto the guide surface 27 from a direction that is orthogonal to the conveyance path C. The second reference tape is the tape in a case where a maximum width tape, whose width is the greatest of any tape that is supplied from the tape cassette 30 that is mounted in the cassette mounting portion 8, is conveyed along the conveyance direction D of the conveyance path C by the minimum length Lmin that is shown in FIG. 7. In the present embodiment, the maximum tape width Wmax is 24 millimeters. The area in which the second projecting portion 140 that satisfies the conditions described above is provided is the area that is shaded by cross-hatching in FIG. 6.

The position in which the second projecting portion 140 is provided, as described above, is determined by taking two factors into consideration. The first factor is that, in the tape printer 1, a label that is created by cutting the maximum width tape is affected comparatively little by the force that bears on it from the cutting mechanism 80, even in a case where the length of the tape is the minimum length. Hereinafter, a label that is created by cutting the maximum width tape to the minimum length Lmin will be called a maximum width/minimum length label. A label that is created by cutting the minimum width tape to the minimum length Lmin will be called a minimum width/minimum length label. In the tape printer 1 in which the second projecting portion 140 is provided within the area that is shaded by cross-hatching in FIG. 6, the maximum width/minimum length label is conveyed toward the discharge outlet 20 in a state in which it is supported by the first projecting portion 130, the second projecting portion 140, and the guide surface 27. In the tape printer 1, the friction between the guide surface 27 and the maximum width/minimum length label is less than in a case where the label is supported only by the guide surface 27. Therefore, in the tape printer 1, the maximum width/minimum length label is discharged more easily than in a case where the label is supported only by the guide surface 27.

The second factor is that the minimum width/minimum length label is discharged more smoothly by keeping the interval between the first projecting portion 130 and the second projecting portion 140 from becoming too wide. In other words, by setting the position of the second projecting portion 140 within the area that is shaded by cross-hatching in FIG. 6, as described above, the second projecting portion 140 can be disposed in a position that is suitable for correcting the direction of movement of the minimum width/minimum length label.

In the tape printer 1 of the present embodiment, the length of the guide surface 27 along the conveyance direction D is longer than the minimum length Lmin. In the present embodiment, the first projecting portion 130 and the second projecting portion 140 are each formed by taking into consideration the friction force between the label and the guide surface 27, as hereinafter described, in order to make it easier to discharge the label from the discharge outlet 20.

Figure 9:
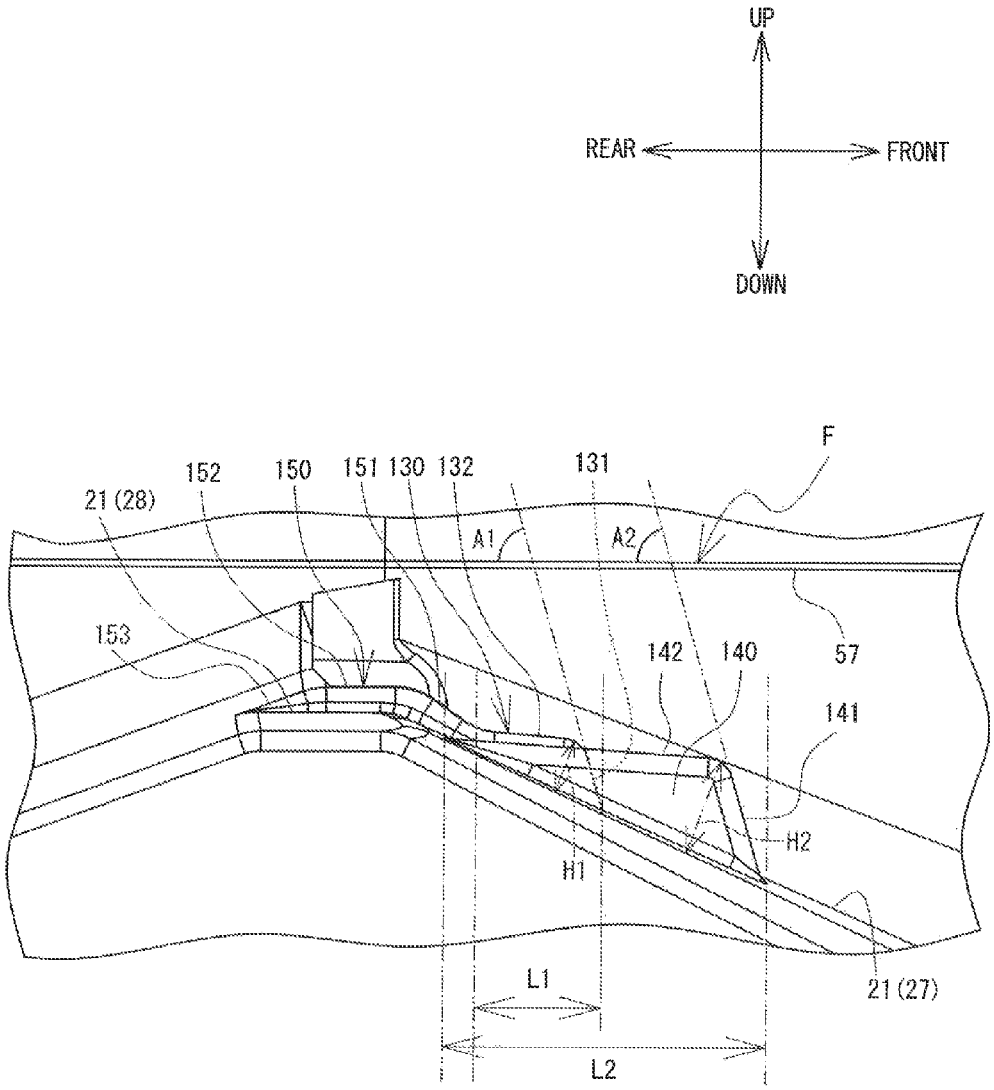
FIG. 9 is an enlarged left side view of the first projecting portion 130 and the second projecting portion 140.

As shown in FIG. 9, a length L1 of the first projecting portion 130 along the conveyance direction D of the conveyance path C is shorter than a length L2 of the second projecting portion 140 along the conveyance direction D of the conveyance path C. A projection height H1 of the first projecting portion 130 in relation to the guide surface 27 is lower than a projection height H2 of the second projecting portion 140 in relation to the guide surface 27. Neither the highest point on the first projecting portion 130 nor the highest point on the second projecting portion 140 is higher than the position in the up-down direction of the conveyance path C of the tape 57. The tape printer 1 can reliably cause the minimum width/minimum length label to come into contact with the second projecting portion 140. In a case where the maximum width/minimum length label is supported by the first projecting portion 130, the second projecting portion 140, and the guide surface 27, the maximum width/minimum length label is tilted toward the hinge 83, such that the height of the maximum width/minimum length label in relation to the guide surface 27 is lower on the side toward the hinge 83 (the right side in the present embodiment). In that case, a force acts on the maximum width/minimum length label in the direction of the right side. Therefore, the tape printer 1 is able to reduce the effect of the force that bears on the maximum width/minimum length label from the cutting mechanism 80. The tape printer 1 is able to discharge the label from the discharge outlet 20 more smoothly than in a case where the length L1 is longer than the length L2 or a case where the projection height H1 is higher than the projection height H2.

The first projecting portion 130 is formed from two top faces 131, 132, such that the first projecting portion 130 has an inverted V shape in a left side view. The top face 131 is positioned in front of the top face 132. The top face 132, toward the rear of the first projecting portion 130, is substantially horizontal. The top face 131, toward the front of the first projecting portion 130, is inclined in relation to an extension plane F of the conveyance path C. In the present embodiment, the extension plane F of the conveyance path C is substantially parallel to the horizontal. Similarly, the second projecting portion 140 is formed from two top faces 141, 142, such that the second projecting portion 140 has an inverted V shape in a left side view. The top face 141 is positioned in front of the top face 142. The top face 142, toward the rear of the second projecting portion 140, is substantially horizontal. The top face 141, toward the front of the second projecting portion 140, is inclined in relation to the extension plane F of the conveyance path C. An inclination angle A1 of the first projecting portion 130 in relation to the extension plane F of the conveyance path C along the conveyance direction D is smaller than an inclination angle A2 of the second projecting portion 140 in relation to the extension plane F of the conveyance path C along the conveyance direction D.

Here, the inclination angle A1 is the angle of the top face 131 with respect to the extension plane F, and the inclination angle A2 is the angle of the top face 141 with respect to the extension plane F. The reason for determining the shapes of the first projecting portion 130 and the second projecting portion 140 as described above will now be explained. Specifically, in the process by which the label is guided to the discharge outlet 20, of the top faces of the first projecting portion 130 and the top faces of the second projecting portion 140, the top face that is the closest to the discharge outlet 20 has the strongest effect on the inclination angle, with respect to the extension plane F, of the label that is in contact with the first projecting portion 130 and the second projecting portion 140. In the tape printer 1, setting the inclination angles A1 and A2 as described above makes it possible to correct the rotational force that bears on the tape when it is cut, in a case where the maximum width/minimum length label is supported by the first projecting portion 130, the second projecting portion 140, and the guide surface 27. Therefore, the tape printer 1 is able to discharge the label from the discharge outlet 20 more smoothly than in a case where the inclination angle A1 is not smaller than the inclination angle A2.

Figure 8:
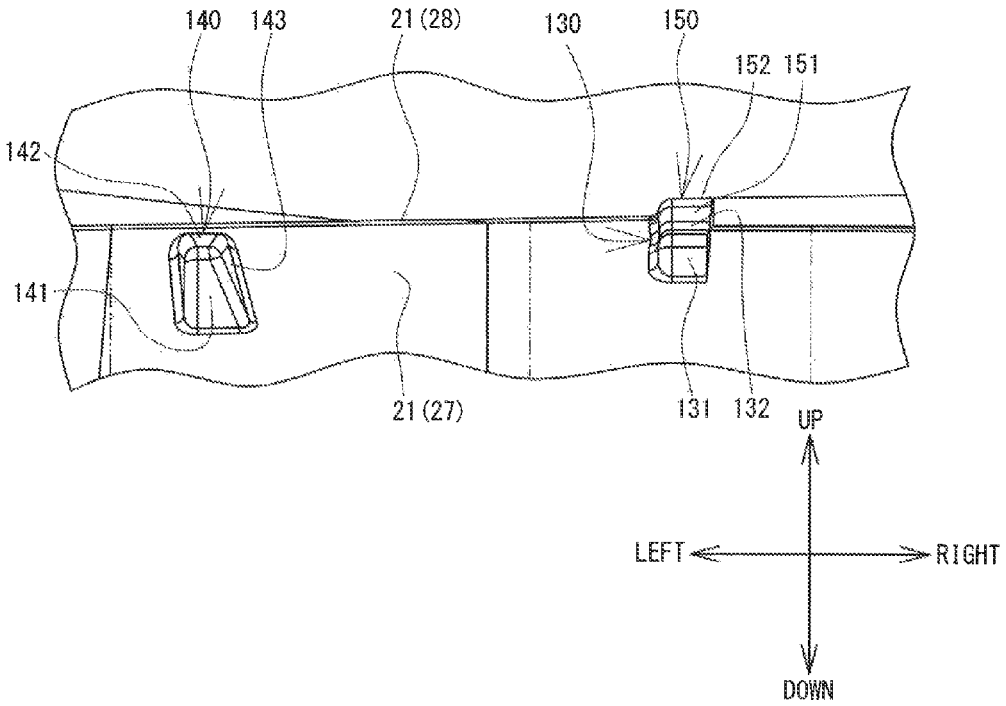
FIG. 8 is an enlarged front view of a first projecting portion 130 and a second projecting portion 140.

As shown in FIG. 8, the second projecting portion 140 includes an inclined surface 143 whose projection height in relation to the guide surface 27 becomes lower toward the side where the hinge 83 is located in the width direction W. In a case where the maximum width/minimum length label is supported by the first projecting portion 130, the second projecting portion 140, and the guide surface 27, the shape of the inclined surface 143 causes the maximum width/minimum length label to tilt toward the side where the hinge 83 is located, such that the height of the maximum width/minimum length label in relation to the guide surface 27 is lower on the side toward the hinge 83 in the width direction (the right side in the present embodiment). Being configured in this way makes it possible for the tape printer 1 to reduce the effect of the force that bears on the maximum width/minimum length label from the cutting mechanism 80 in a case where the maximum width/minimum length label is supported by the first projecting portion 130, the second projecting portion 140, and the guide surface 27. Therefore, the tape printer 1 is able to discharge the label from the discharge outlet 20 more smoothly than in a case where the inclined surface 143 that is described above is not provided.

The operation of the tape printer 1 when printing is performed will be explained briefly with reference to FIGS. 3, 10, and 11, using as an example a case in which the laminated type of the tape cassette 30 is mounted in the cassette mounting portion 8 and the minimum width/minimum length label is created. The roller 46, which is driven through the shaft 100, operates in coordination with the movable feed roller 79 to pull out the film tape (not shown in the drawings) that is wound around the spool 41. The spool 44, which is rotationally driven through the shaft 95, pulls the unused ink ribbon out from the spool 42 in synchronization with printing speed. The film tape that has been pulled out from the spool 41 is conveyed along the conveyance path C and passes to the outer side of the spool 42. The film tape is then conveyed between the thermal head 10 and the platen roller 78 with the ink ribbon overlaid on its surface. At this time, the thermal head 10 uses the ink ribbon to print characters on the printing surface of the film tape.

Thereafter, the used ink ribbon is peeled away from the printed film tape and wound up by the spool 44. At the same time, the double-sided adhesive tape (not shown in the drawings) is pulled out from the spool 40 by the coordinated operation of the roller 46 and the movable feed roller 79. The double-sided adhesive tape is guided between and wound around the roller 46 and the movable feed roller 79, where it is overlaid on and affixed to the printing surface of the printed film tape. The film tape (that is, the tape 57) to which the double-sided adhesive tape has been affixed is conveyed by a specified distance toward the discharge outlet 20 and is cut by the cutting mechanism 80.

Figure 11:
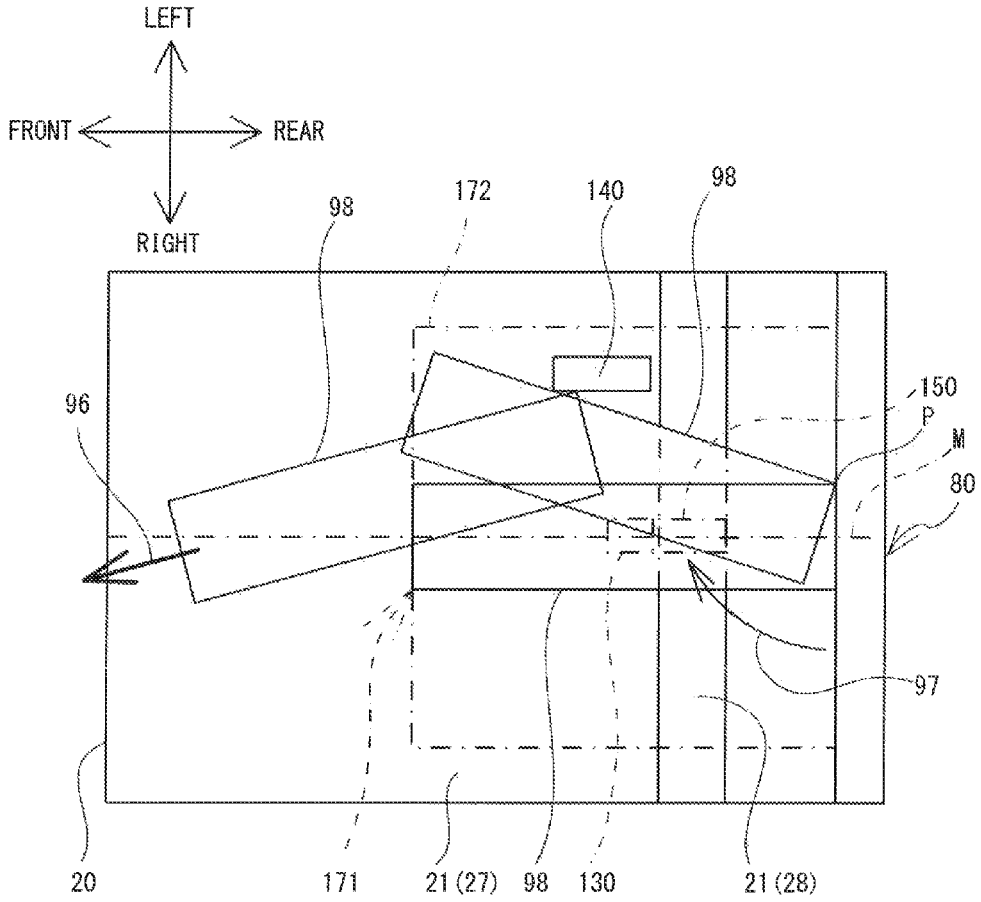
FIG. 11 is an explanatory figure that schematically shows a discharge path for a minimum width/minimum length label 98 in a plan view.

As shown schematically in FIG. 11, a force in the direction of an arrow 97 acts on a minimum width/minimum length label 98 that has been cut by the cutting mechanism 80. Therefore, the minimum width/minimum length label 98 rotates clockwise in a plan view. The first projecting portion 130 is formed on the center line M in the left-right direction of the first projected image 171 in an area that is comparatively close to the boundary between the guide surface 27 and the horizontal surface 28. Therefore, as shown in FIG. 11, the minimum width/minimum length label 98 reliably comes into contact with the first projecting portion 130, even in a state in which a force from the cutting mechanism 80 bears on the minimum width/minimum length label 98 in the direction of the arrow 97, such that the minimum width/minimum length label 98 has rotated in the direction of the arrow 97 around a corner point P that is on the opposite side of the minimum width/minimum length label 98 from the hinge 83 in the width direction W. In other words, the first projecting portion 130 is in an area, within the area that is covered by the first projected image 171, that overlaps the image of the first reference tape that is projected onto the guide surface 27 from a direction that is orthogonal to the conveyance path C, the first reference tape having been rotated in the direction of the arrow 97 around the corner point P until the first reference tape abuts the second projecting portion 140.

Figure 10:
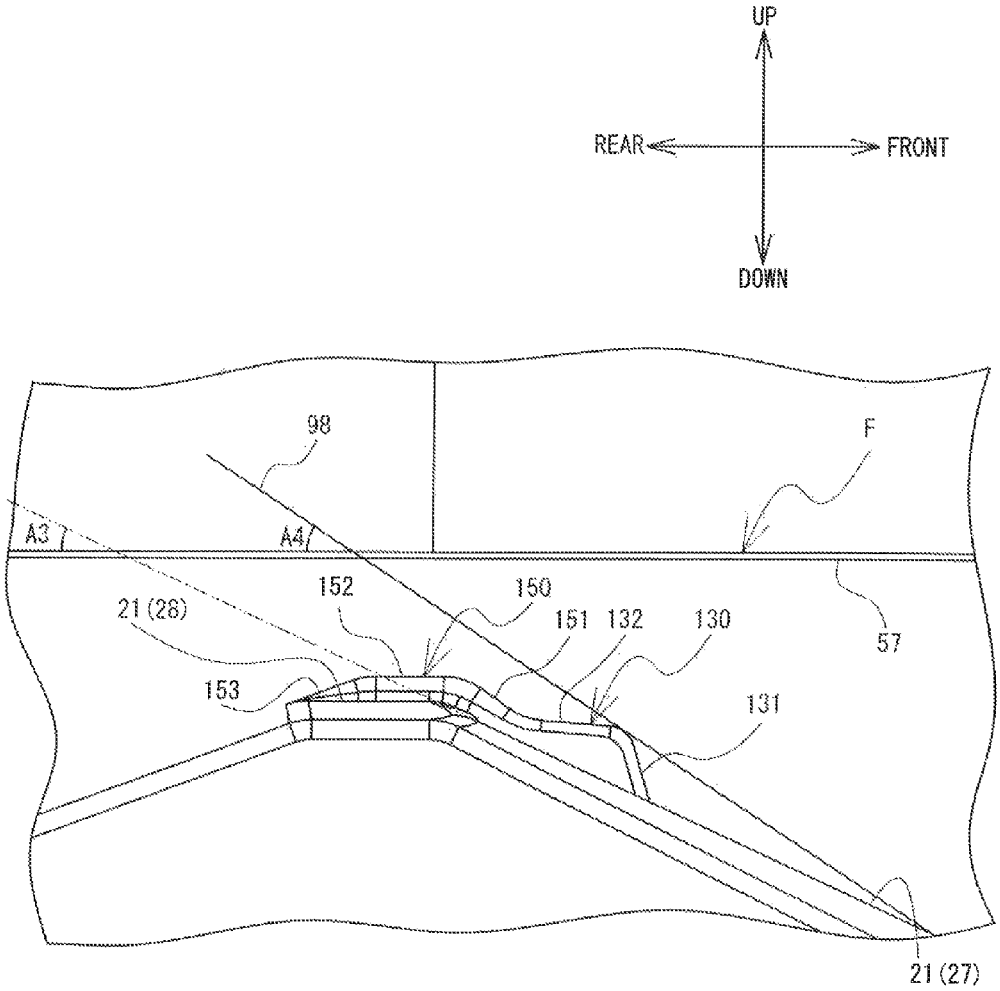
FIG. 10 is a left side view of the first projecting portion 130.

As shown in FIG. 10, an inclination angle A4 of a label that is in contact with the top face of the first projecting portion 130, in relation to the extension plane F of the conveyance path C, is larger than an inclination angle A3 of the guide surface 27 in relation to the extension plane F of the conveyance path C. Therefore, the force that acts on the minimum width/minimum length label 98 in the direction of the discharge outlet 20 becomes greater, making it easier for the minimum width/minimum length label 98 to be conveyed to the discharge outlet 20. As shown in FIG. 11, the direction of movement of the minimum width/minimum length label 98 that is in contact with the second projecting portion 140 is corrected, such that the minimum width/minimum length label 98 moves in the direction that is indicated by an arrow 96. Therefore, even in a case where the length LF of the guide surface 27 is longer than the length Lmin, the minimum width/minimum length label 98 does not cling to the guide surface 27, but passes through the discharge outlet 20 and is discharged from the tape printer 1.

In the tape printer 1, the label that is made by the cutting of the tape is supported by at least the first projecting portion 130 and the guide surface 27. The friction between the label and the guide surface 27 of the tape printer 1 is less than in a case where the label is supported only by the guide surface 27. Therefore, in the tape printer 1, the label is discharged more easily than in a case where the label is supported only by the guide surface 27.

In that type of the tape printer 1 that is provided with the hinged type of cutting mechanism 80, the label that is made by the cutting of the tape 57 is subject to a force from the cutting mechanism 80 that rotates the label in the direction of the discharge outlet 20, with a corner point of the tape that is on the opposite side of the tape from the side where the hinge 83 is located in the width direction W serving as a base point. In other words, the label that is made by the cutting of the tape 57 is not conveyed toward the discharge outlet 20. With regard to the effect of the force that bears on the label from the cutting mechanism 80, the effect of the force that bears on a narrow label is greater than the effect of the force that bears on a wide label. Furthermore, the effect of the force that bears on a short label is greater than the effect of the force that bears on a long label. In other words, the label on which the effect of the force from the cutting mechanism 80 is greatest is the minimum width/minimum length label. In the tape printer 1, the minimum width/minimum length label moves smoothly toward the second projecting portion 140 and comes into contact with the second projecting portion 140 in a state in which the label is supported by the first projecting portion 130 and the guide surface 27. The movement direction of the minimum width/minimum length label is corrected by the label's coming into contact with the second projecting portion 140, and the minimum width/minimum length label is conveyed smoothly toward the discharge outlet 20. In a case where the distance to the discharge outlet 20 from the position where the tape 57 is cut, that is, the position of the blades of the cutting mechanism 80, is comparatively long, the label is discharged smoothly from the discharge outlet 20 even if conditions exist that maximize the effect of the force from the cutting mechanism 80.

The tape printer of the present disclosure is not limited to the embodiment that is described above, and various types of modifications can be made within the scope of the present disclosure. For example, any of the modifications from (A) to (D) below may be made as desired.

(A) The types of tape cassette that can be mounted in the tape printer, the types of tape that can be contained in the tape cassette, and the structure of the tape cassette may be modified as desired. For example, the minimum value and the maximum value for the tape width may each be modified as desired. The structure of the cassette mounting portion of the tape printer may be modified as desired in accordance with the structure of the tape cassette. The minimum length Lmin of the tape may be modified as desired.

(B) The hinge of the cutting mechanism of the tape printer may be disposed on either the right side or the left side of the first projecting portion and the second projecting portion, as long as it is positioned at one of the right edge and the left edge of the tape. The positioning of the second projecting portion may be modified as desired, in accordance with the positioning of the hinge.

(C) The first projecting portion may be disposed anywhere within the area that is covered by the first projected image. An area where, when the label is created, it is highly probable that the minimum width/minimum length label will come into contact with the first projecting portion is determined based on experiments or simulation results, taking into account the force that bears on the minimum width/minimum length label from the cutting mechanism. The first projecting portion may then be provided within the area that is determined. The shape of the first projecting portion 130, including the values for the projection height H1 of the first projecting portion 130 in relation to the guide surface 27, the length L1 of the first projecting portion 130 along the conveyance direction D, and the inclination angle A1 in relation to the extension plane F, may be modified as desired. In the embodiment that is described above, the first projecting portion 130 and the third projecting portion 150 may also be provided separately from one another.

Figure 12:
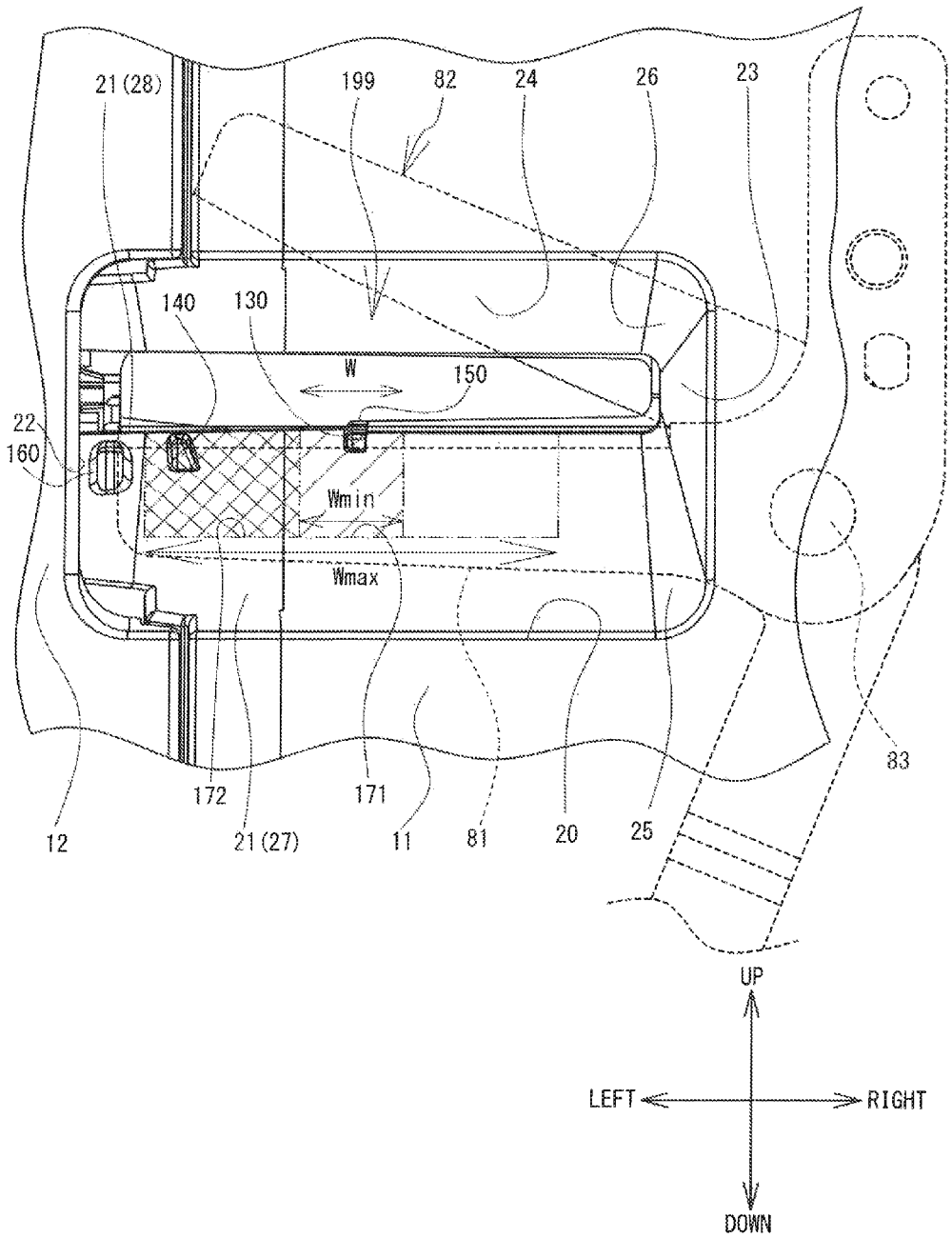
FIG. 12 is an enlarged partial front view of the area around a discharge portion 199 in a modified example.

(D) It is sufficient for the second projecting portion to be provided to the outside of the first projected image and on the opposite side of the first projected image from the hinge of the cutting mechanism. As long as those conditions are satisfied, the second projecting portion may also be provided to the outside of the second projected image. An additional second projecting portion 140 and an additional second projecting portion 160 may also be provided outside of the first projected image 171 and on the opposite side of the first projected image 171 from the hinge of the cutting mechanism, as in a discharge portion 199 in a modified example that is shown in FIG. 12. In FIG. 12, the same reference numerals are assigned to the members that are the same as in the tape printer 1 of the embodiment that is described above that is shown in FIG. 6, and explanations of those members will be omitted. The shape of the second projecting portion 160 in FIG. 12 may be set as desired, taking into account the shapes of the first projecting portion 130 and the second projecting portion 140, the size of the label, and the like. The shape of the second projecting portion 140, including the values for the projection height H2 of the second projecting portion 140 in relation to the guide surface 27, the length L2 of the second projecting portion 140 along the conveyance direction D, the inclination angle A2 in relation to the extension plane F, and the shape of the inclined surface 143, may be modified as desired. Therefore, the length L1 of the first projecting portion 130 along the conveyance direction D of the conveyance path C may be shorter than or not shorter than the length L2 of the second projecting portion 140 along the conveyance direction D, for example. Similarly, the projection height H1 of the first projecting portion 130 in relation to the guide surface 27 may be greater than or not greater than the projection height H2 of the second projecting portion 140 in relation to the guide surface 27.

What is claimed is:

1. A tape printer, comprising:

a cassette mounting portion that is configured to be provided with a tape cassette containing a tape that is a printing medium;

a cutting mechanism that is a hinged type of cutting mechanism that includes a hinge that is positioned in a side of the tape in a width direction, the cutting mechanism being configured to cut the tape, which is supplied from the tape cassette that is provided in the cassette mounting portion and is conveyed along a specified conveyance path;

a discharge outlet that is provided on a downstream side of the cutting mechanism in a conveyance direction of the conveyance path along which the tape is conveyed, the discharge outlet discharging a label that is the tape that has been cut by the cutting mechanism;

a guide surface that is provided between the cutting mechanism and the discharge outlet and that guides the label toward the discharge outlet;

a first projecting portion that is provided in an area that is covered by a first projected image, the first projected image being an image of a minimum width tape that is projected onto the guide surface from a direction that is orthogonal to the conveyance path, being projected in a position to which the minimum width tape has been conveyed from the cutting mechanism toward the discharge outlet by a minimum length of the label, the minimum width tape being a tape whose width is the smallest of any tape that is supplied from the tape cassette that is provided in the cassette mounting portion; and a second projecting portion that is provided within the guide surface to an outside of the first projected image and on an opposite side of the first projected image from the hinge.

2. The tape printer according to claim 1, wherein the second projecting portion is provided within the guide surface to the outside of the first projected image, on the opposite side of the first projected image from the hinge, and inside an area that is covered by a second projected image, the second projected image being an image of a maximum width tape that is projected onto the guide surface from a direction that is orthogonal to the conveyance path, being projected in a position to which the maximum width tape has been conveyed from the cutting mechanism toward the discharge outlet by the minimum length of the label, the maximum width tape being a tape whose width is the greatest of any tape that is supplied from the tape cassette that is provided in the cassette mounting portion.

3. The tape printer according to claim 2, wherein a length of the first projecting portion in the conveyance direction of the conveyance path is shorter than a length of the second projecting portion in the conveyance direction of the conveyance path, and a projection height of the first projecting portion in relation to the guide surface is lower than a projection height of the second projecting portion in relation to the guide surface.

4. The tape printer according to claim 2, wherein an inclination angle of the first projecting portion in relation to an extension plane of the conveyance path along the conveyance direction is smaller than an inclination angle of the second projecting portion in relation to the extension plane of the conveyance path along the conveyance direction.

5. The tape printer according to claim 2, wherein the second projecting portion includes an inclined surface whose projection height in relation to the guide surface becomes lower toward the side of the tape in the width direction where the hinge is positioned.

6. The tape printer according to claim 2, wherein a projection height of the first projecting portion in relation to the guide surface is lower than a projection height of the second projecting portion in relation to the guide surface, and the highest point on the second projecting portion is positioned on the downstream side of the highest point on the first projecting portion in the conveyance direction, the highest point on the second projecting portion being the highest point in relation to the guide surface, and the highest point on the first projecting portion being the highest point in relation to the guide surface.

* * * * *